US007834286B2

(12) United States Patent
Michel et al.

(10) Patent No.: US 7,834,286 B2
(45) Date of Patent: Nov. 16, 2010

(54) SWITCHING DEVICE

(75) Inventors: Andreas Michel, Wilhelmsdorf (DE); Axel Müller, Berg (DE)

(73) Assignee: RAFI GmbH & Co. KG, Berg (DE)

( * ) Notice: Subject to any disclaimer, the term of this patent is extended or adjusted under 35 U.S.C. 154(b) by 0 days.

(21) Appl. No.: 12/284,171

(22) Filed: Sep. 19, 2008

(65) Prior Publication Data

US 2009/0107820 A1 Apr. 30, 2009

(30) Foreign Application Priority Data

Oct. 27, 2007 (DE) ..... 10 2007 051 466

(51) Int. Cl.
*H01H 13/00* (2006.01)

(52) U.S. Cl. ..... 200/339

(58) Field of Classification Search ..... 200/339, 200/553, 558, 561, 7, 18, 1 B, 16 B
See application file for complete search history.

(56) References Cited

U.S. PATENT DOCUMENTS 5,115,108 A 5/1992 Ogawa et al.
5,378,862 A 1/1995 Tasaka et al.
5,689,095 A * 11/1997 Kawase ..... 200/6 A
5,693,920 A * 12/1997 Maeda ..... 200/1 B
5,753,874 A 5/1998 Kossakowski
6,437,259 B1 8/2002 Geppert et al.
6,693,246 B1 * 2/2004 Rudolph et al. ..... 200/339
6,737,592 B1 5/2004 Hoang et al.
6,914,202 B2 7/2005 Sugimoto et al.
6,974,919 B2 12/2005 Mori et al.
7,071,435 B2 7/2006 Altmann

FOREIGN PATENT DOCUMENTS

DE 102007014988 4/2007

* cited by examiner

*Primary Examiner*—Felix O Figueroa
(74) *Attorney, Agent, or Firm*—Pandiscio & Pandiscio

(57) ABSTRACT

An electrical switch device including a housing having an actuator cap movably mounted thereon and a plurality of contact switches disposed therein. The cap is operable to engage the contact switches within the housing to activate the switches in a selected sequence.

11 Claims, 14 Drawing Sheets

SWITCHING DEVICE

BACKGROUND OF THE INVENTION

1. Field of the Invention

The invention relates to a switching device for producing at least one switching signal that can be evaluated electrically, comprising a housing with an externally accessible actuator cap mounted on it in a swiveling arrangement and one or more transmission elements mounted in the housing that have their first end face facing the inside of the actuator cap and their second end face facing a contact switch installed in the housing, and interacting with this when the actuator cap is activated.

2. Description of the Prior Art

A two-stage switch is disclosed in EP 1463077 B1, the actuator cap of which that is mounted in a swiveling arrangement on the housing acts on a first subsection of the transmission element that is configured as an actuator foot, by means of which the contact switch is activated when the actuator cap is pressed down. The movement angle of the actuator cap is limited in this case, so that the movement travel of the actuator foot largely corresponds to the swiveling angle of the actuator cap.

Therefore, as soon as the actuator cap makes contact with a stop, the actuator foot is no longer moved. Now, in order to activate a second contact switch arranged opposite the first contact switch, the actuator cap is held pressed against the stop and moved about the fulcrum formed in this way opposite to the direction of the first movement travel, so that the actuator cap moves a second actuator foot of the transmission element in the direction of a contact switch arranged below that. In the area of the second contact switch, there is also a stop formed on the actuator cap, by means of which the movement travel of the second actuator foot is restricted.

The two contact switches are accordingly activated by tilting the actuator cap in two opposite directions. The switching signals produced by the contact switches can be electrically evaluated, for example in order to activate a servomotor used for moving a window pane installed in a vehicle.

It has proven to be a disadvantage with this state of the art that only two switching signals can be produced, which exclusively specify two different operating positions, namely moving the window pane until the first contact switch is deactivated, or moving the window pane as far as the end position if both contact switches are closed. Although a corresponding electronic control unit with an associated electrical evaluation unit allows these operating positions to be adapted to any requirement profiles, having additional operating positions makes it necessary to provide additional two-stages switches of this kind, therefore in order to achieve raising of the window in a car as well it would be necessary to install another switch.

Once the second switching position has been reached in the two-stage switch according to EP 1 463 077 B1, the actuator switch can no longer be swiveled or moved in the direction of the original actuation direction, because the actuator cap is positioned against the stop. The confirmation pressure communicated to the user is therefore significantly characterized by reaching the stop; the state of the art does not provide a defined movement possibility beyond the moment of switching. Rather, the stop is reached directly and the movement travel of the actuator cap is stopped.

A further disadvantage lies in the fact that the actuator cap for actuating the two contact switches initially has to be moved in a first swiveling direction and, once the stop limiting this movement has been reached, it has to be moved in a second, opposite, swiveling direction in order to actuate both contact switches simultaneously.

SUMMARY OF THE INVENTION

It is therefore a task of the present invention to provide a switching device of the aforementioned kind such that a plurality of different switching signals is provided and, at the same time, it is guaranteed that actuation of the switching device is possible in a movement sequence that is as even as possible and goes beyond the last switching point.

Furthermore, the switching device should make it possible to achieve overlapping movements, namely about an axis of rotation, and a linear movement in order to generate a plurality of switching procedures on an electrically operated device, vehicle or the like by actuating the switching device.

The control contour worked into the inside of the actuator cap in both the longitudinal and transverse directions is divided up into differently configured subsections, thereby allowing the transmission elements to be arranged inside the housing laterally and/or in height with almost complete freedom in relation to one another. This means the switching device can be optimally adapted to the given installation situations and, at the same time, the function of the switching device is not impaired. Rather, the actuator cap can produce at least two different switching signals in one swiveling direction by actuating two switching contacts and can produce two further different switching signals in a swiveling direction opposite to the first swiveling direction which are produced by actuating at least one other switching contact. This means, for example, a window in a car can be opened and closed by pressing the actuator cap forwards in relation to the installation position in order to open the window and backwards in order to close it. Different switching signals of this kind can then be evaluated by an electronic control unit by means of which the servomotor is controlled in a corresponding way.

Furthermore, the actuator cap is mounted on the housing so as to be movable in a linear direction, with the effect that one or more further groups of actuation elements can be supplied to it. The particular group of actuation elements in this case is equipped with specified electrical signals that are allocated to activating certain electrical components in an electrical device, a car or the like.

Due to the geometrical shape of the control contour, the actuator cap is mounted on the transmission element in such a way that it is held in a fixed location by the transmission elements and by the fixing onto the housing.

BRIEF DESCRIPTION OF THE DRAWINGS

The drawings shows five sample embodiments configured in accordance with the present invention, the details of which are explained below.

DESCRIPTION OF THE PREFERRED EMBODIMENTS

Figure 10:
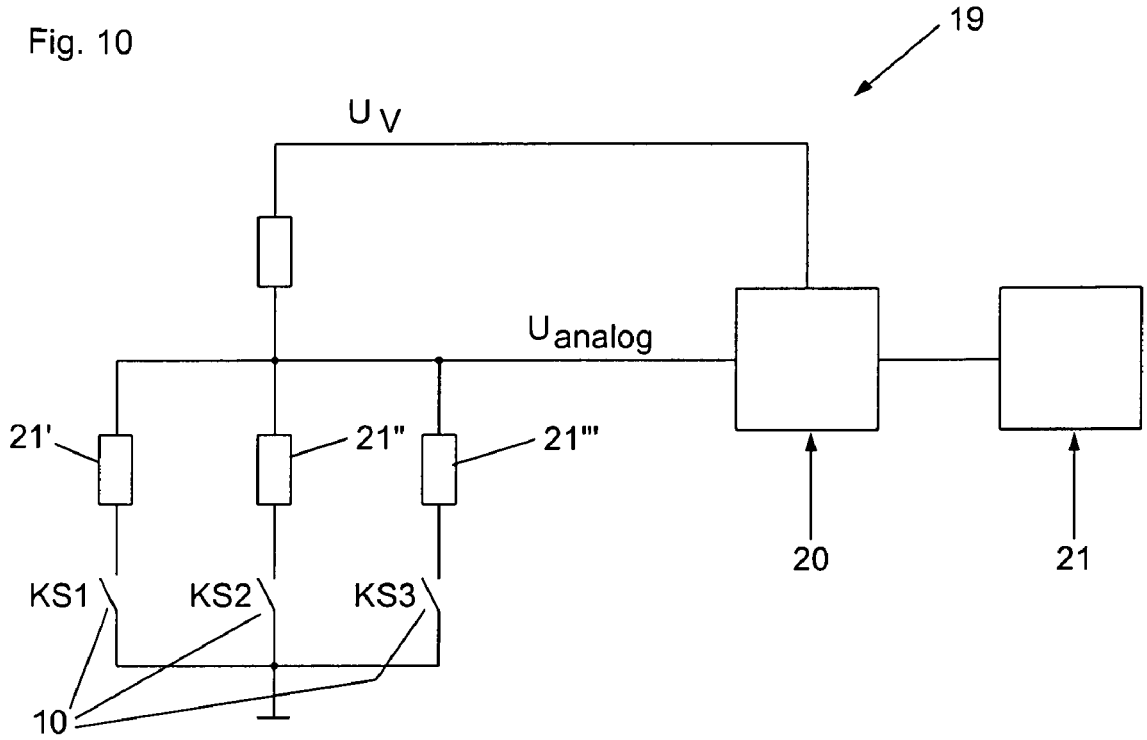
FIG. 10 shows an electrical circuit for evaluating the switching signals generated by the switching device in accordance with FIG. 1.

In the switching device 1 shown in FIGS. 1 to 6, it should be possible to convert a mechanical movement into one or more electrical switching signals 2, 2', 2", 2'", (FIG. 11) with the effect that, with the help of the circuit 19 shown in FIG. 10, a drive motor 21 can be operated by a control unit 20. The switching device 1 in this case can be installed in particular in a vehicle and, by means of this, it should be possible to lower or raise the windows integrated in the vehicle. Further technical applications for the switching device 1 in accordance with the present invention are for shifting seat positions and adjusting the exterior mirror and/or rear-view mirror. This list is merely given by way of example, since it goes without saying that the switching device 1 can also be used outside motor vehicles; this is shown in FIGS. 12 to 15.

The switching device 1 in accordance with FIGS. 1 to 6 consists of a housing 3 with an actuator cap 4 mounted on it by means of two pins 5 running flush with one another in a swiveling arrangement about an axis of rotation 6 formed by the pins 5. The actuator cap 4 can therefore be moved about the axis of rotation 6 in two opposite directions relative to the housing 3 that is firmly installed. Each stop 7' provided on the housing 3 when the actuator cap 4 has reached one of its two limit positions.

FIGS. 2 to 6 show the design structure of the switching device 1, comprising three transmission elements 8, 8' and 8". The transmission elements 8, 8' and 8" are mounted in the housing 3 so as to be axially movable and are each configured as a tappet 11. The tappet 11 has a first end face 14 and a second end face 15. The first end face 14 faces the inner surface of the actuator cap 4 and each second end face faces a contact switch 10. The actuator cap 4 is in zero-play contact with at least two of the first end faces 14 of the tappet 11, which is independent from the particular operating position of the actuator cap 4. The status of the actuator cap 4 shown in FIG. 2 reflects the rest position.

The inner surface of the actuator cap 4 facing the particular tappet 11 has a control contour 12 worked into it, which consists of three subsections 13, 13' and 13". Each subsection 13, 13' and 13" is assigned to a particular transmission element 8, 8' or 8". The two outer subsections 13 and 13' are in a mirror-image arrangement with one another and run at an angle out of the horizontal plane. The middle subsection 13" has a semicircular indentation in which the first end face 14 of the middle transmission elements 8" are embedded in the non-actuated condition.

Three springs 9 are supported on the housing 3, each of which interact with one of the tappets 11, with the effect that the particular tappet 11 is pressed against the force of spring 9 on the particular subsection 13, 13' or 13" of the control contour 12 of the actuator cap 4.

Figure 3:
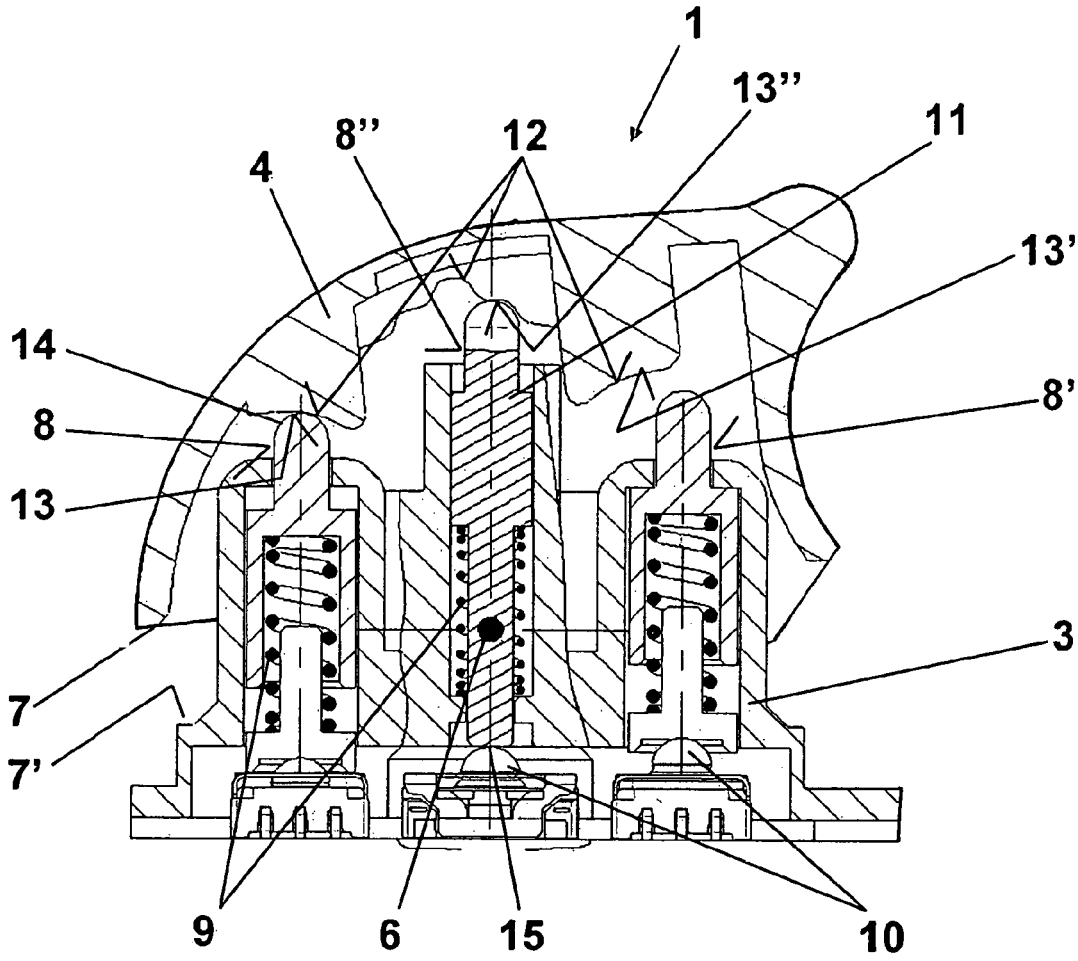
FIG. 3 shows the switching device in accordance with FIG. 2, in a first operating position.

FIG. 3 shows a first operating position of the switching device 1, because the actuator cap 4 is swiveled in the direction of the transmission element 8 about the axis of rotation 6. This means the first subsection 13 of the control contour 12 acts on the first end face 14 of the transmission element 8, by means of which the tappet 11 is pressed axially in the direction of the contact switch 10 arranged below it, against the force of the spring 9. This means the tappet 11 activates the contact switch 10 that is configured as a diaphragm switch and a switching signal 2 is produced that can be evaluated electrically.

The subsection 13' that is assigned to the transmission element 8' is raised off the first end face 14 of the tappet 11 in this operating position, with the effect that the transmission element 8' remains in its rest position. The subsection 13" that is assigned to the middle transmission element 8" is initially formed so that the tappet 11 of the middle transmission element 8" is not actuated, with the effect that the contact switch 10 arranged below it does not produce any electrical signal.

Figure 4:
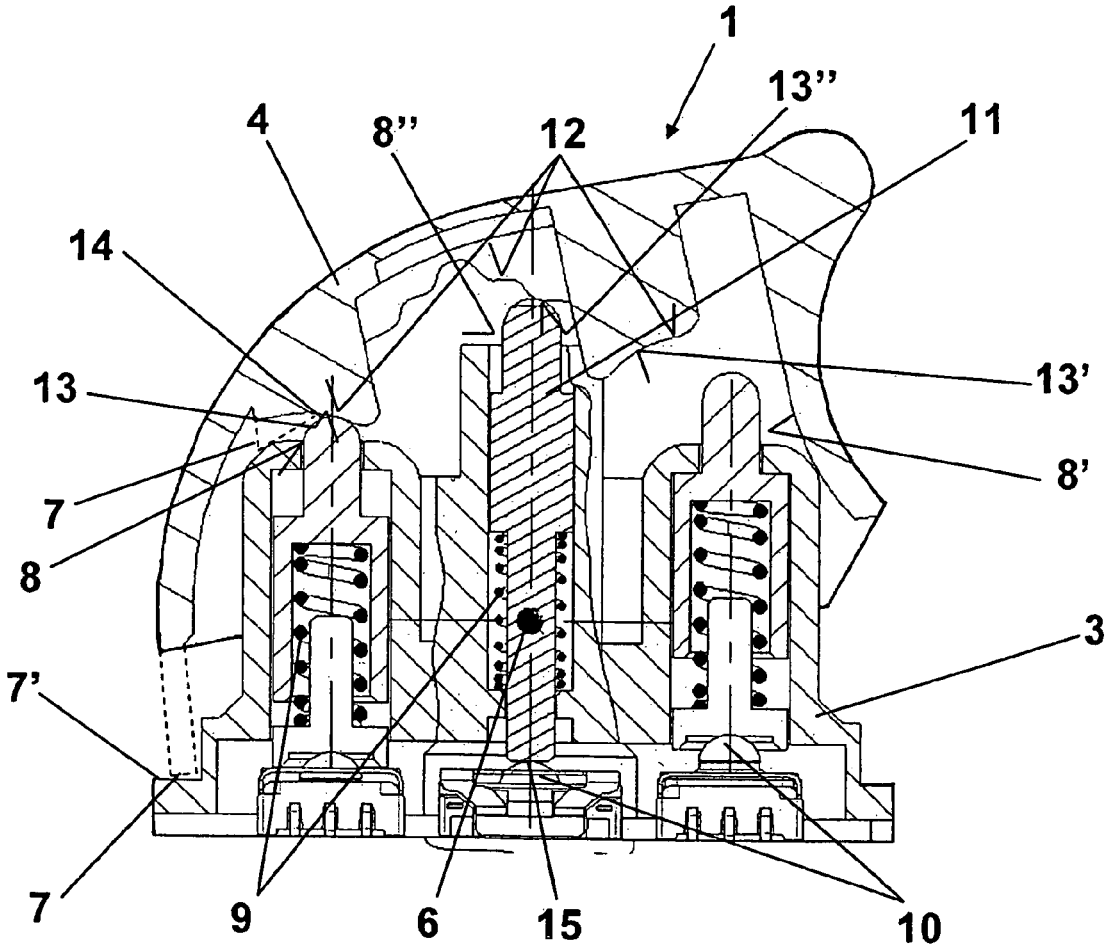
FIG. 4 shows the switching device in accordance with FIG. 2, in a second operating position.

FIG. 4 shows the second operating position of the switching device 1, which now corresponds to the limit position for the swivel angle of the actuator cap 4. The stop 7 that is formed on the actuator cap 4 makes contact with the housing wall that is provided as a limiting surface 7', with the effect that the actuator cap 4 is in its limit position. It is also feasible for a stop 7 to be formed to the side adjacent to the subsection 13 or 13' which acts on the housing 3 on the inside, and therefore limits the swiveling angle of the actuator cap 4.

However, the stop 7 only acts on the limiting surface 7' after the second generated switching procedure, and this produces a comfortable switching feel because the actuator cap 4 can be moved beyond the second switching point.

The middle subsection 13" of the control contour 12 is configured in such a way that it pushes the middle tappet 11 axially in the direction of the contact switch 10 against the force of the spring 9, with the effect that the middle contact switch 10 also produces a switching signal 2" that can be evaluated electrically. The control contour 12 in this operating position is fully raised off the first end face 14 of the outer transmission element 8', with the effect that no forces act on this.

Figure 5:
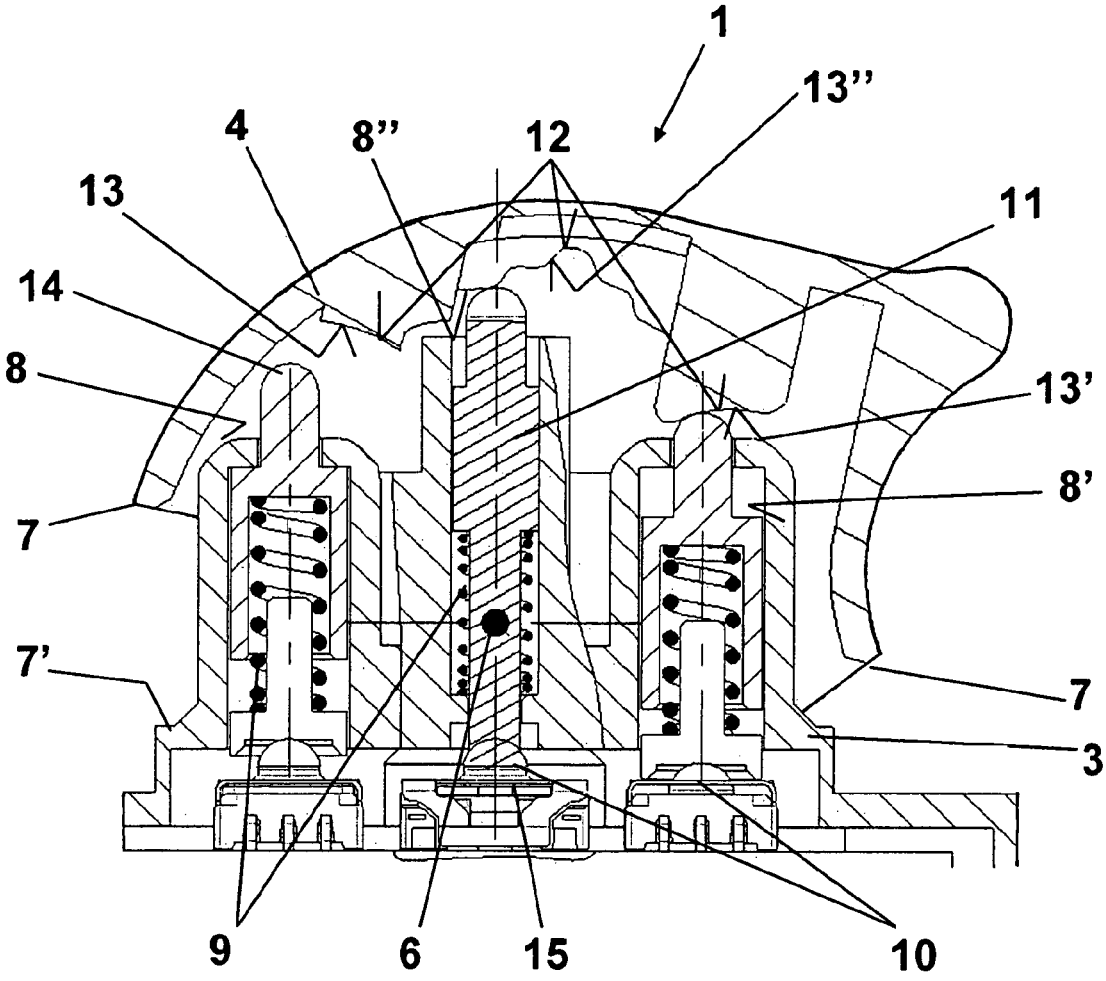
FIG. 5 shows the switching device in accordance with FIG. 2, in a further operating position.

FIG. 5 shows the further operating position when the actuator cap 4 has been moved about the point of rotation 6 opposite to the swiveling angle shown in FIGS. 3 and 4. The transmission element 8' and 8" is actuated in this operating position. The intermediate position, in which only the transmission element 8' is pressed in the direction of the contact switch 10, is not shown because this operating position largely corresponds to FIG. 3.

Figure 6:
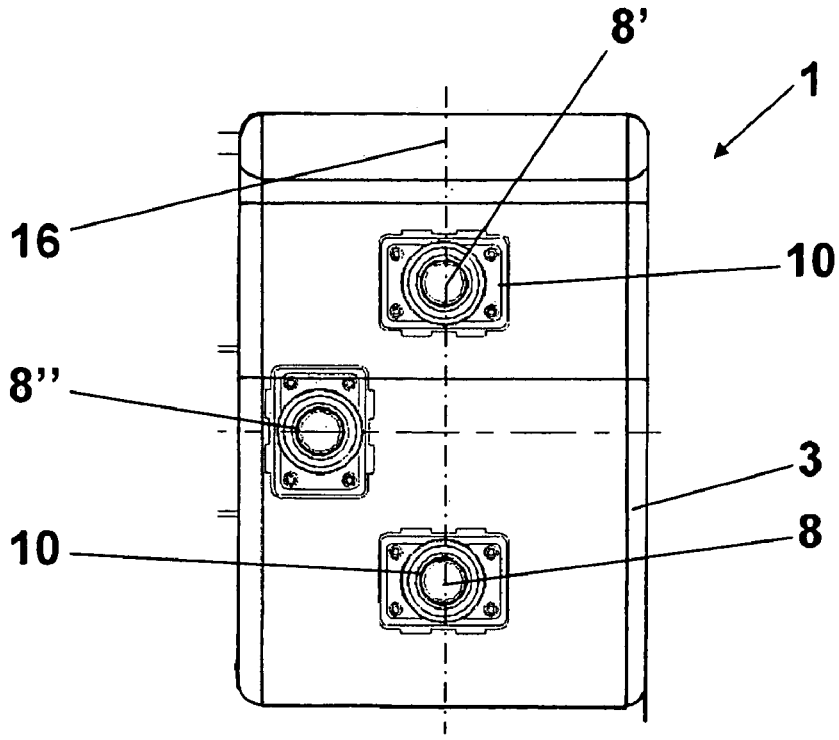
FIG. 6 shows the switching device in accordance with FIG. 2, in a plan view.

FIG. 6 shows that the two outer transmission elements 8 and 8' lie on a common axis of symmetry 16 of the housing 3 and that the middle transmission element 8" is arranged offset to the side in relation to this plane. The particular subsections 13, 13' or 13" in the inside of the actuator cap 4 are assigned to the positions of the transmission elements 8, 8' and 8".

Figure 7:
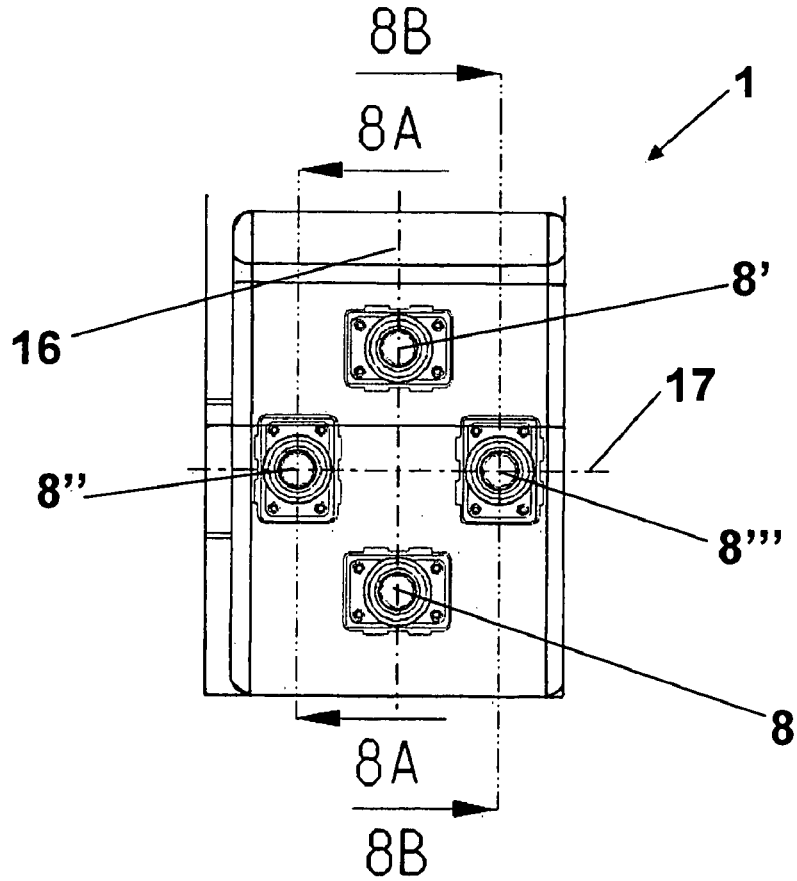
FIG. 7 shows a second sample embodiment of a switching device in accordance with FIG. 1, in a plan view.

FIG. 7 shows a sample embodiment comprising four transmission elements 8, 8', 8", and 8'". The two middle transmission elements 8" and 8'" are arranged flush with one another on a common axis of symmetry 17, with the effect that these form one plane. The planes formed by the transmission elements 8 and 8' and by the transmission elements 8" and 8'" are accordingly at right angles to one another. The four transmission elements 8, 8', 8" and 8'" are arranged symmetrically to one another.

Figure 8A:
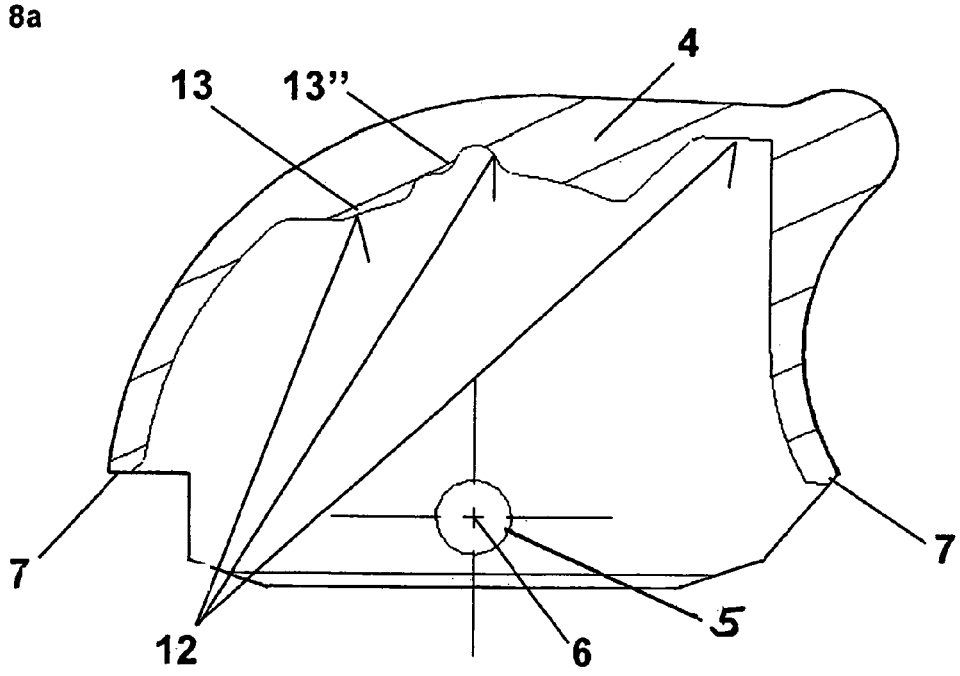
FIG. 8*a* shows the switching device in accordance with FIG. 7, along section VIIIa-VIII.
Figure 8B:
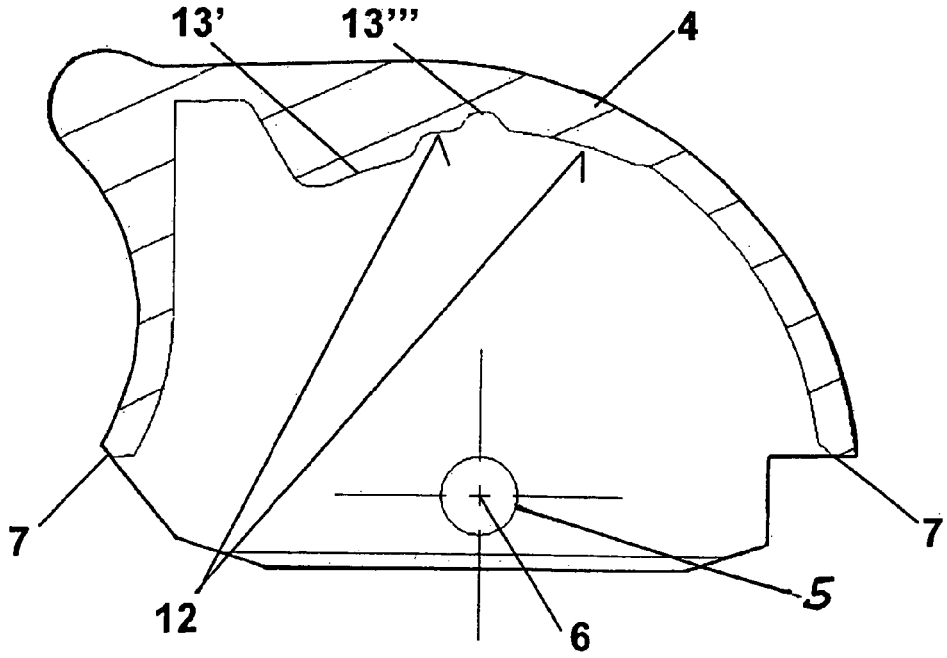
FIG. 8*b* shows the switching device in accordance with FIG. 7, along section VIIIb-VIIId.

The configuration of the control contour 12 can be seen in FIGS. 8*a* and 8*b*. The subsections 13, 13', 13" and 13'" face the particular transmission elements 8, 8', 8", 8'". However, the control contour 12 has the special feature that the subsections 13" and 13'" run in a mirror image to one another and the particular transmission element 8" or 8'" is only moved axially in the direction of the contact switch 10 arranged below it in the particular swiveling position. The subsections 13 and 13' are also aligned in a mirror-image arrangement in relation to one another, and only activate the tappet 11 of the particular transmission element 8 or 8' arranged below it when the actuator cap 4 is moved in a particular swiveling direction.

Figure 1:
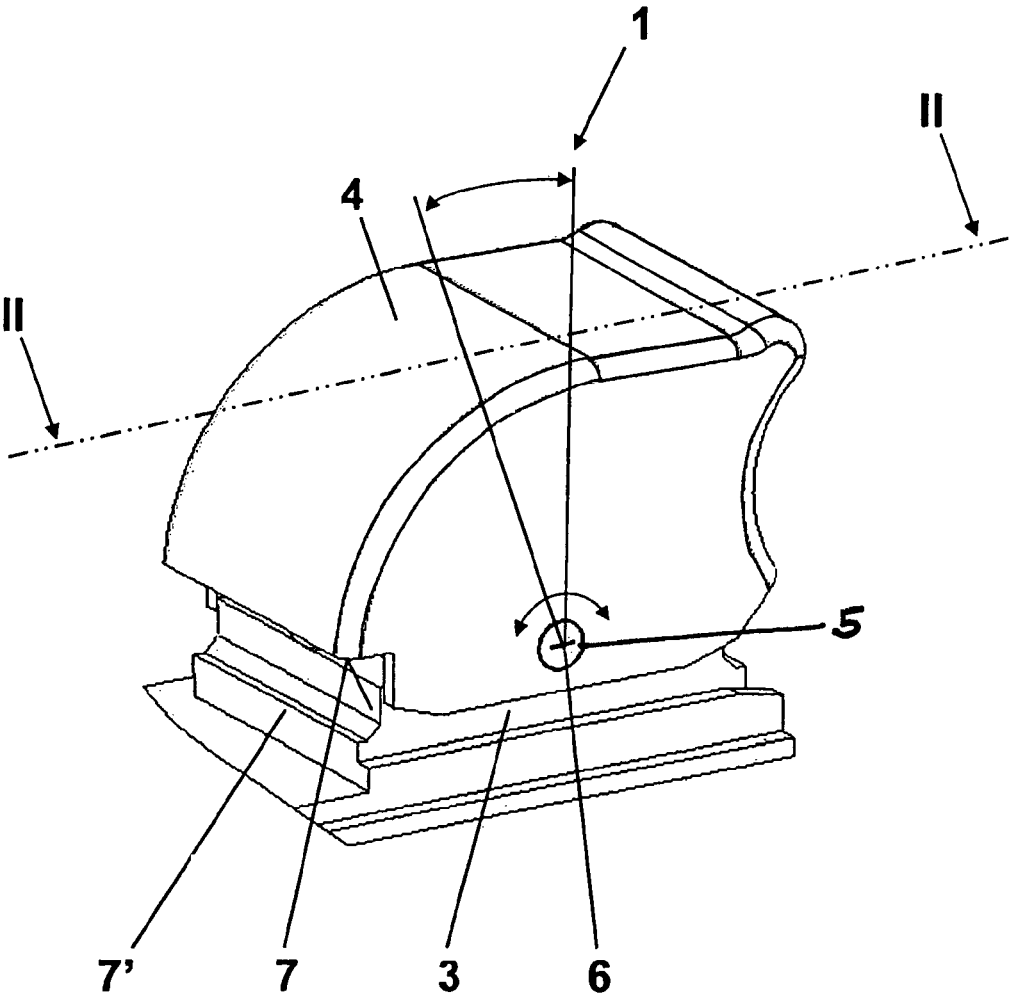
FIG. 1 shows a switching device consisting of a housing with an actuator cap mounted on it that can be swiveled about an axis of rotation in two directions.
Figure 2:
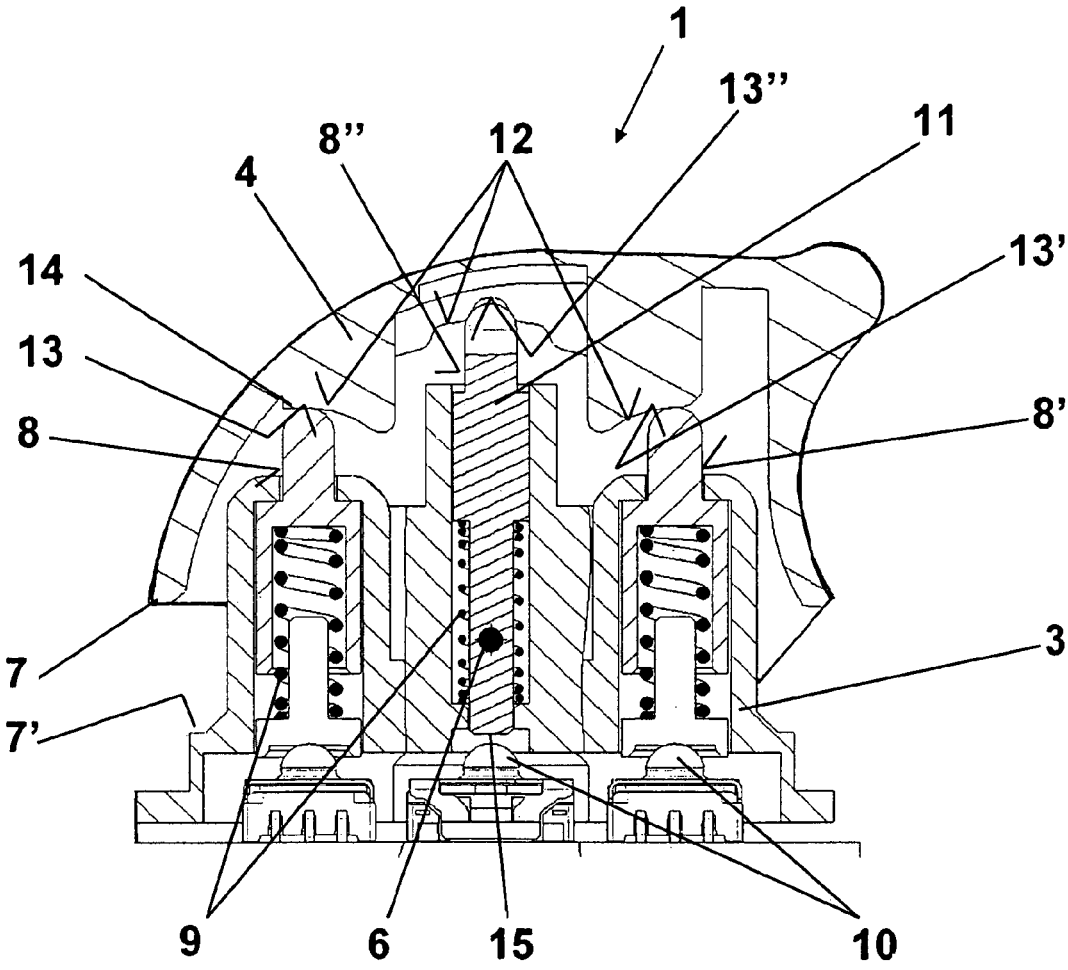
FIG. 2 shows an initial sample embodiment of a switching device in accordance with FIG. 1, in the starting position, along section II-II.

FIG. 1 shows that the actuator cap 4 can be swiveled forwards or backwards about the point of rotation 6. Therefore, if the actuator cap 4 is pressed backwards, the transmission element 8 is initially actuated and, as the movement continues, subsequently the middle transmission element 8" is actuated; if, on the other hand, that actuator cap 4 is moved in the opposite direction, i.e. forwards, then initially the outer transmission element 8' and subsequently the middle transmission element 8'" is moved in the direction of the contact switch 10. It is also feasible for installation situations involving corresponding differences in height for design reasons, e.g. a spatial offset of the transmission elements 8, 8', 8" and 8'" in relation to one another, to be compensated. Furthermore, any required switching travels can be achieved by changing the control contour 12 accordingly.

Figure 9:
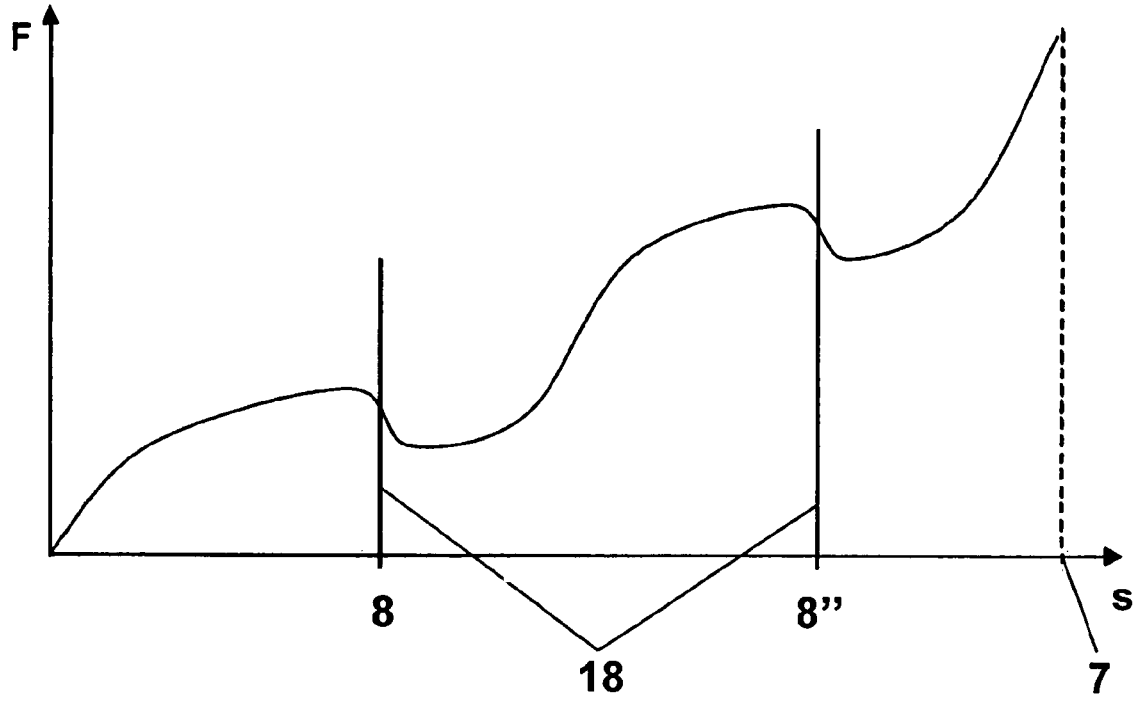
FIG. 9 shows a force/travel diagram indicating the movement sequences of the switching device in accordance with FIG. 1.

FIG. 9 shows a force/travel diagram which illustrates in a schematic way the switching process of the switching device 1 when the actuator cap 4 is actuated. The reference number 18 here indicates the switching points when the first transmission element 8 and subsequently the second transmission element 8" activate the contact switch 10. The contact switch 10 configured as a diaphragm namely snaps through in the form of a snap disc, with the effect that a defined specified force resistance must be overcome when switching, and is reduced by the switching.

Accordingly, the actuator cap 4 can still be moved in the direction of the housing surface configured as a stop surface 7' even after the second switching procedure. This means a switching procedure takes place which guarantees that the actuator cap 4 can even be moved beyond the second switching point 18. This delivers a pleasant switch feeling for the user.

Figure 11:
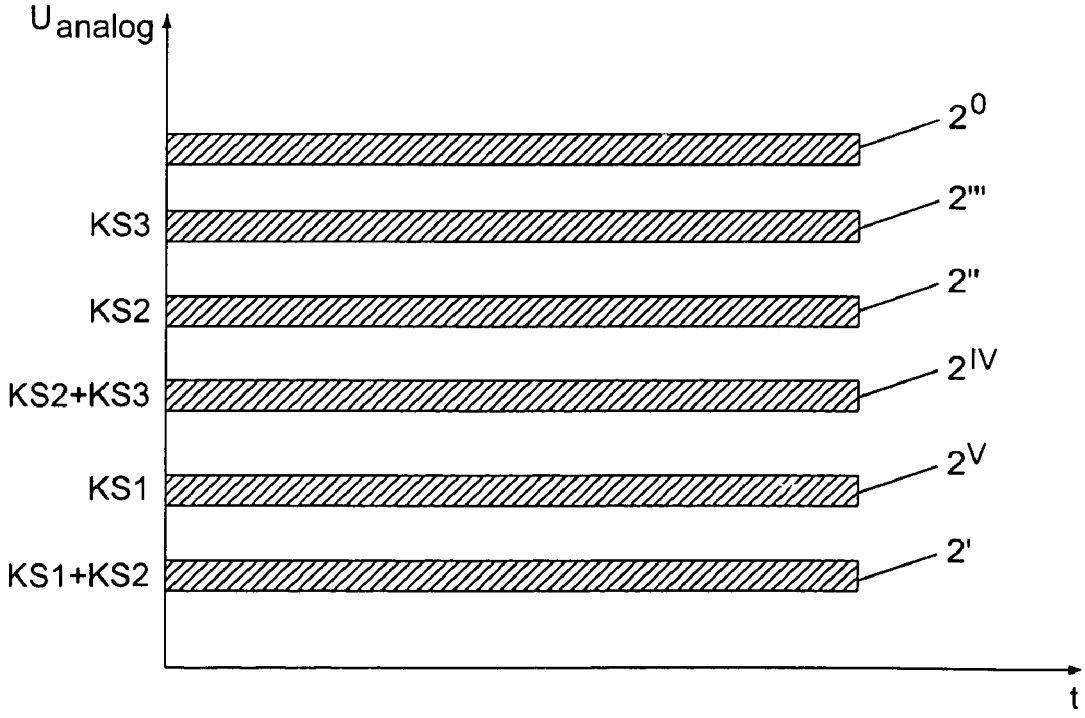
FIG. 11 shows a diagram in which the voltages produced at the individual contact switches of the switching device in accordance with FIG. 1 are indicated.

FIGS. 10 and 11 show a circuit 19 as well as a diagram for evaluating the produced switching signals 2, 2', 2", $2^{IV}$. The contact switches 10 shown schematically with KS1, KS2 and KS3 are initially open, with the effect that the resistor 21' connected in parallel to the switches results in a voltage value $2^{0}$ is interpreted by the control unit to mean that the switching device 1 is non-actuated. This means the drive motor 21 electrically connected to the control unit 20 is not activated.

If the actuator cap 4 and therefore the first transmission element 8 is now pressed in the direction of the contact switch 10 (KS1) arranged below it, a resistor 21' connected in series results in a voltage drop, with the effect that a switching signal 2 is produced that is detected by the control unit 20. This means for the control unit 20, for example, that the drive motor 21 must be activated until the contact switch KS1 is once again opened.

As has already been explained, both contact switches KS1 and KS2 are pressed in the second operating position, with the effect that both resistors 21' and 21" connected in parallel to one another produce a switching signal 2' that in turn has a voltage value that is different from other switching positions. The control unit 20 interprets this in such a way that the drive motor 21 must be actuated irrespective of the operating position of the actuator cap 4 until a window pane has reached its limit position.

Actuation of the transmission element 8' and 8" in turn produces different voltage values that the control unit 20 converts into electrical switching signals for the drive motor 20 in accordance with an evaluation ECU.

If the switching device 4 is made up of four transmission elements 8, 8', 8", 8'" then additional switching signal 2 to 2' are produced, which can be used for controlling completely different kinds of electrical devices.

Figure 12:
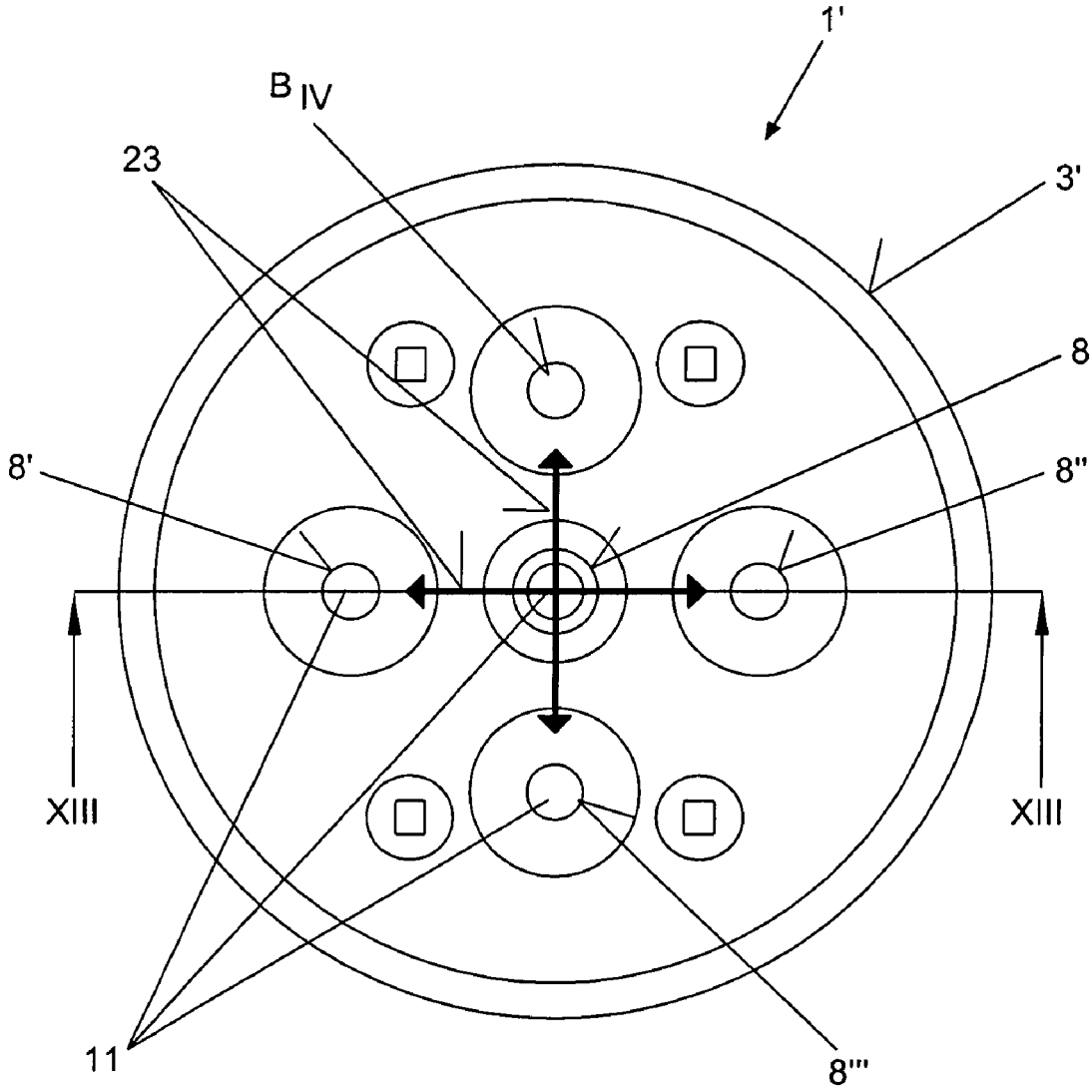
FIG. 12 shows a third sample embodiment of a switching device with an actuator cap configured as a ball, that can be tilted in two planes running at right angles to one another, in a plan view.
Figure 13:
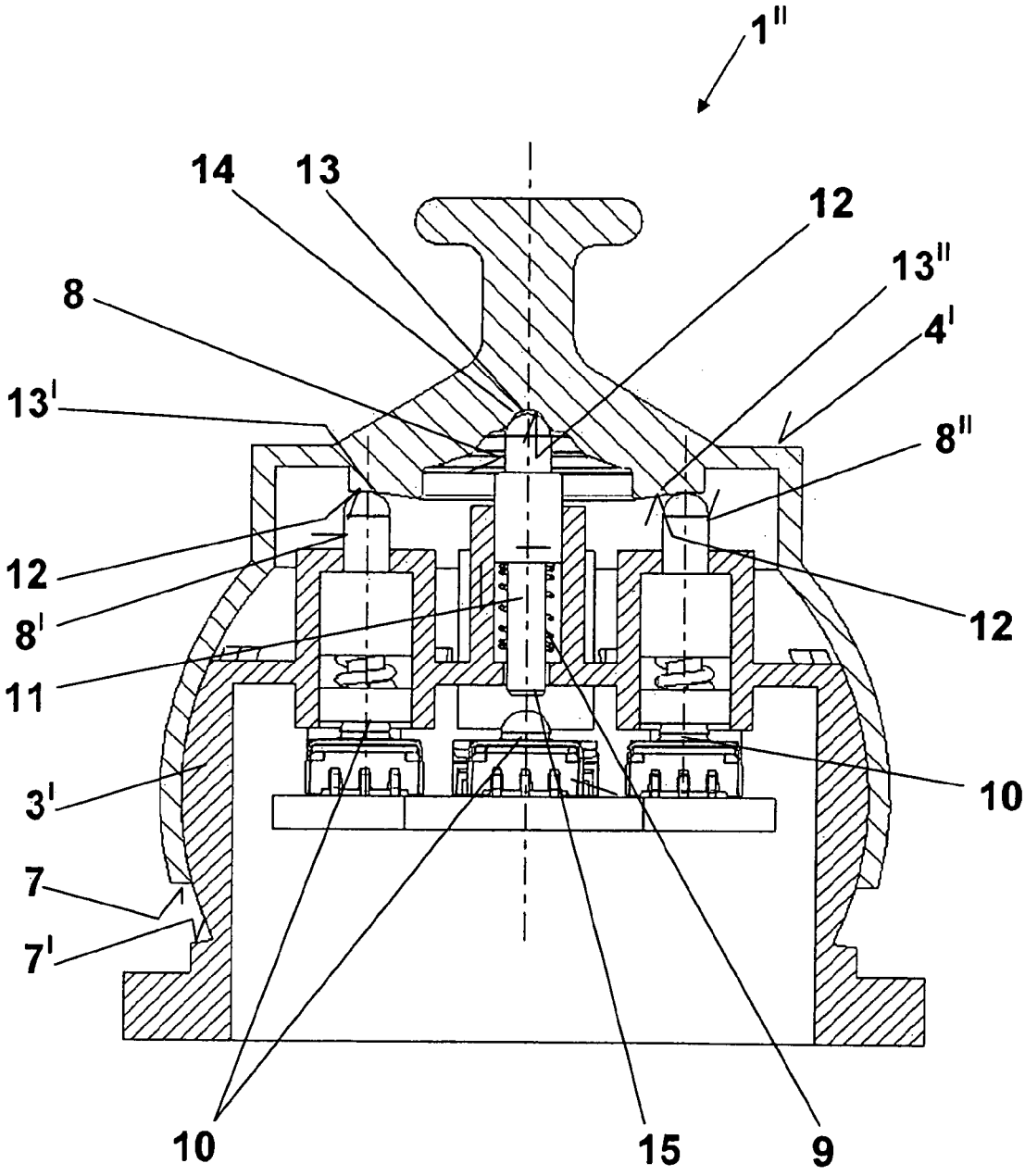
FIG. 13 shows the switching device in accordance with FIG. 12, along section XIII-XIII.

FIGS. 12 and 13 show a switching device 1' comprising a housing 3' with an outer contour has an outer curvature in the area of overlap with an actuator cap 4'. The inner contour of the actuator cap 4' in this case is adapted to the outer contour of the housing 3' in such as way that the actuator cap 4' is held and guided by the outer contour of the housing 3' and, at the same time, can be moved in two schematically represented tilting planes 23 that are at right angles to one another. The deflection of the actuator cap 4' can take place without steps in this case.

Five transmission elements 8, 8', 8", 8'", $8^{IV}$ are arranged inside the housing 3', which are offset laterally in relation to one another. The inside of the actuator cap 4' has the control contour 12 adapted to the arrangement of transmission elements 8, 8', 8", 8'", $8^{IV}$, which is divided up into different subsections 13, 13', 13", 13'", $13^{IV}$. Each of the subsections 13 to $13^{IV}$ is assigned to one of the transmission elements 8 to $8^{IV}$, with the effect that when the actuator cap 4' is swiveled or tilted, the particular subsection 13 to $13^{IV}$ can be brought to interact with the particular transmission element 8 to 4'.

The curvature of the housing 3' and the configuration of the inner contour of the actuator cap 4' that is adapted to it are principally configured with a cupola shape in the overlapping area. The free end of the actuator cap 4' therefore forms a stop 7 which makes contact with an end face 7' of a schematically drawn device or a housing, and therefore limits the tilting movement of the actuator cap 4'.

Figure 14:
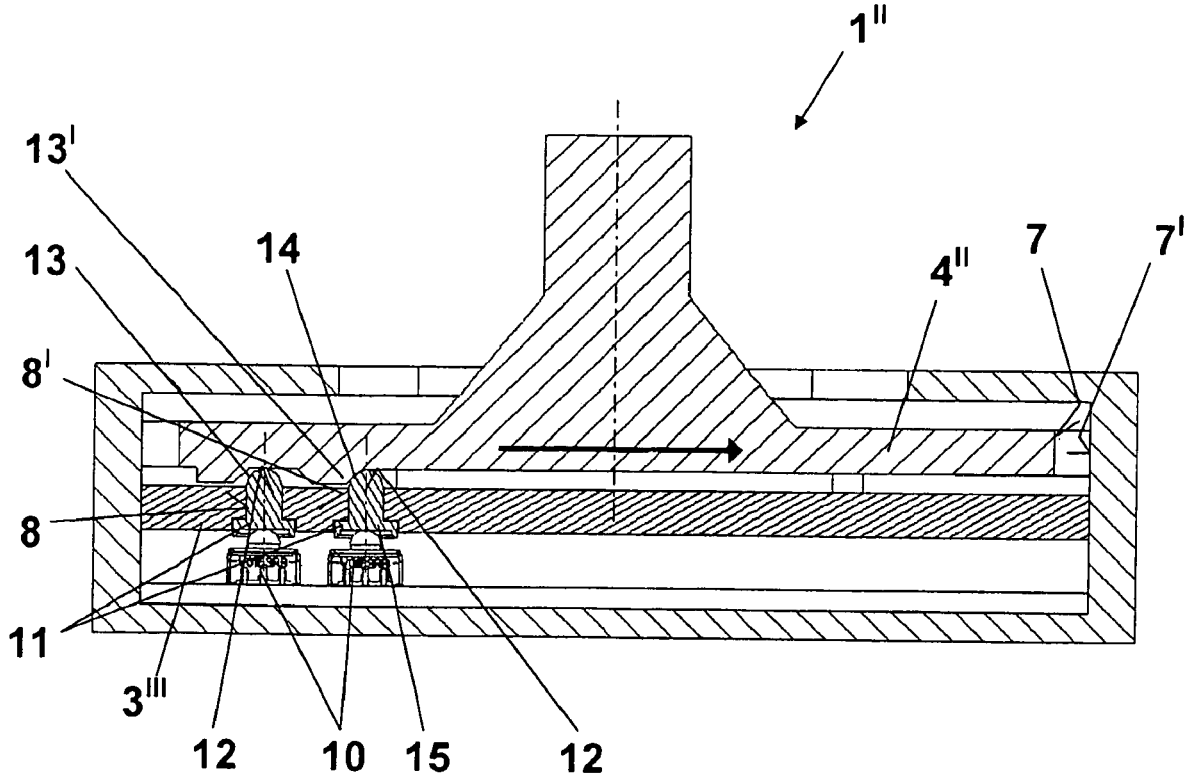
FIG. 14 shows a fourth sample embodiment of a switching device in which the actuator cap is held on a housing and can be moved in one linear direction, in a cross section.

FIG. 14 shows a switching device 1" made up of an actuator cap 4" that can be moved in a linear direction. The actuator cap 4" can therefore be moved in the longitudinal direction of the housing 3. The inside of the actuator cap 4" has one of the subsections 13 and 13' of the control contour 12 assigned to it for each of the transmission elements 8 and 8' accommodated in the housing 3. A stop 7' is formed on the housing 3, by means of which the movement direction of the actuator cap 4" is limited. In the opposite direction to the stop 7' formed on the housing 3, the actuator cap 4", i.e. the slide switch, can be made to perform a movement of any required length. This means a plurality of transmission elements 8 or 8' can be provided in the housing 3, by means of which the particular subsections 13, 13' of the control contour 12 can be activated.

The actuator cap 4' has two guide grooves running flush with one another in parallel to the longitudinal axis of the cap, with projections formed on the inside of the housing 3 engaging in the grooves and therefore supporting the actuator cap 4' without thereby limiting the linear movement possibility of the actuator cap 4".

Figure 15:
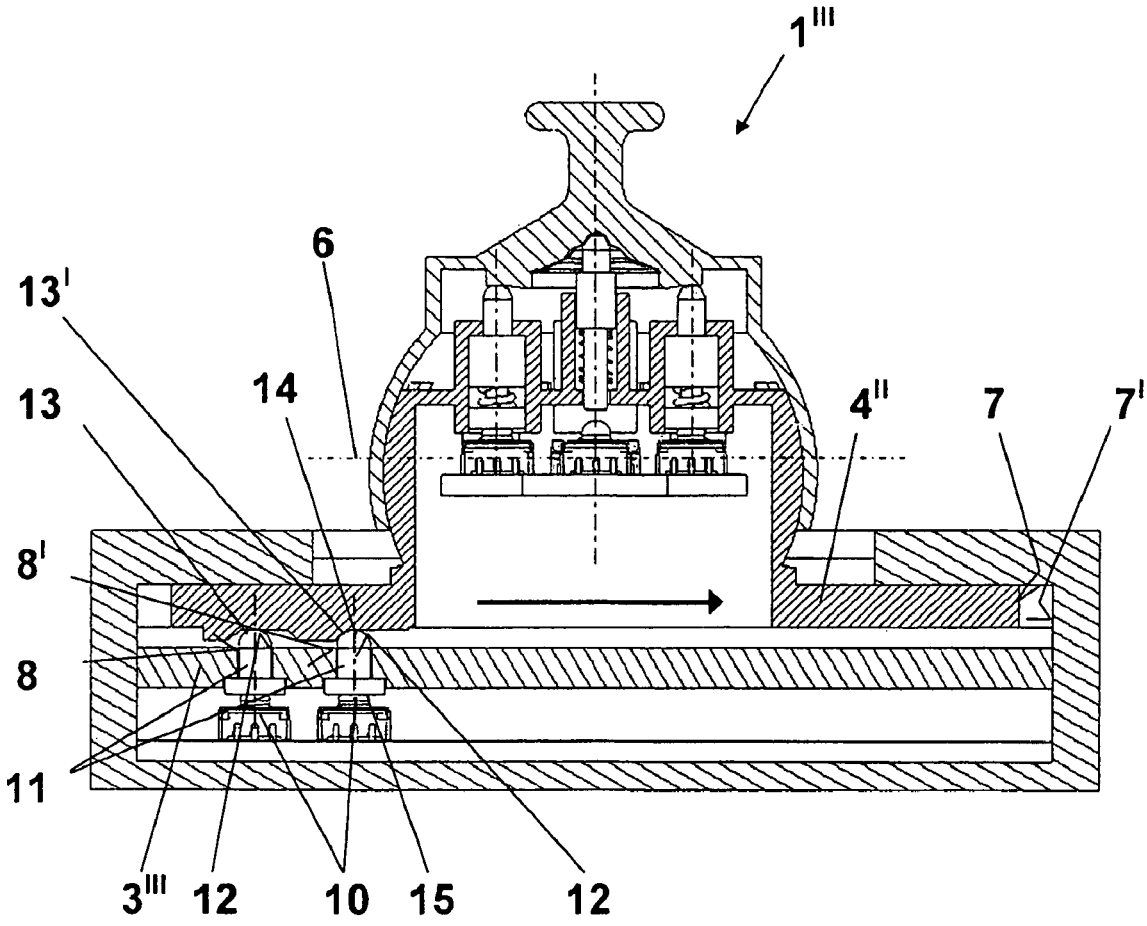
FIG. 15 shows a fifth sample embodiment of a switching device in which the actuator cap can be moved both about an axis of rotation and in a linear movement and which has two or more groups of transmission elements each of which has a predefined electrical control function for an electrical device, in a cross section
Figure 16:
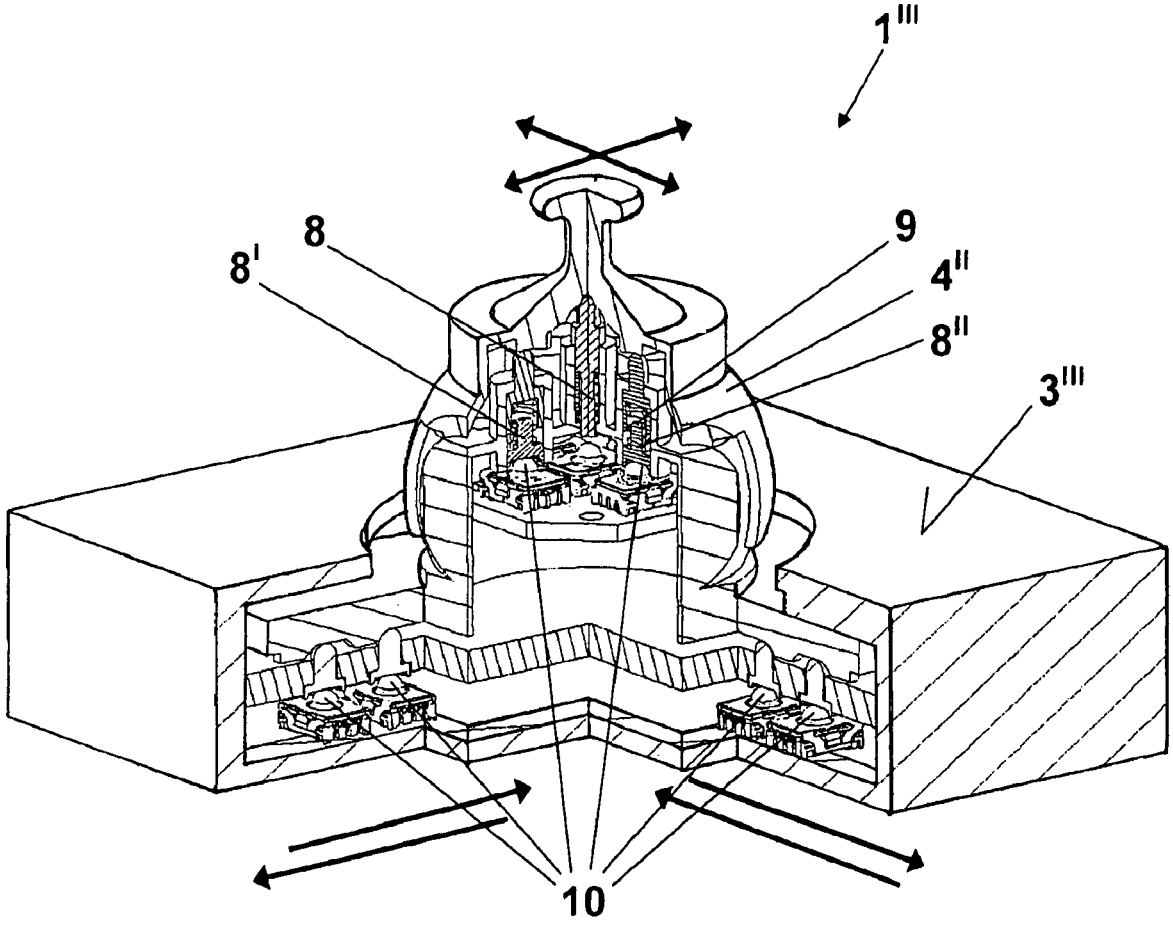
FIG. 16 shows the switching device in accordance with FIG. 15 in a perspective cutaway view.

FIGS. 15 and 16 show a switching device 1'" by means of which electrical switching signals can be generated both by tilting the actuator cap 4" and by moving it in a linear direction. In this case, the actuator cap 4" and the transmission elements 8, 8', 8" and 8'" arranged below it are arranged as shown in FIGS. 12 and 13. The actuator cap 4" is mounted in a housing 3'" so as to allow linear movement. Two guide grooves running parallel and flush with one another are therefore worked into the inside of the housing 3'", and the actuator cap 4" is pushed into them. The housing 3" in this case is principally divided into two legs at right angles to one another. As shown in FIG. 14, two of the transmission elements 8 and 8' are arranged in the two legs of the housing 3'". Therefore, if the actuator cap 4" is arranged in a rest position in accordance with the initial situation shown in FIG. 16, the transmission elements 8 and 8' in the legs of the housing 3" to be activated by movement of the actuator cap 4" are not activated and corresponding signals are produced by the actuator cap 4" and by each of the transmission elements 8, 8', 8" and 8'" arranged below the cap.

If the actuator cap 4" is now moved to the first group of transmission elements 8 and 8' in the first leg of the housing 3', the control contour assigned to the transmission elements 8 and 8' produces a corresponding switching signal by means of which a control ECU directly recognizes that another electrical device or parts thereof should be controlled with the actuator cap 4". Furthermore, the actuator cap 4" in the second leg of the housing 3'" can be moved in order to activate a second group of transmission elements 8 and 8'. Each group of transmission elements 8 and 8' in this case is assigned to a particular electronic component for controlling it.

The number of transmission elements 8, 8' is adapted to the control function of the electrical device in this case.

What is claimed is:

1. A switching device for producing at least one electrical signal, the device comprising a housing defining at least three legs and an externally accessible actuator cap mounted on said housing and covering top and side portions of said housing, and a plurality of coil spring-biased transmission elements mounted each in one of said legs of said housing, each of said transmission elements having a first end face facing a contoured inner surface of said actuator cap one coil spring biased toward urging engagement of the transmission element first end face with a proximate portion of a contoured inner surface of said cap, and a second end face of one of said transmission elements facing a contact switch in the housing and engageable with the contact switch when said actuator cap is activated, wherein at least three of the transmission elements are arranged in parallel in the housing spatially offset laterally and/or in height in relation to one another, and said actuator cap is pivotable about at least one axis extending through a central one of said transmission elements and is held in a linear movable arrangement in one of two axial directions by said housing, and wherein the contoured surface disposed on the inner surface of said actuator cap, is adapted to move said transmission elements axially against the spring bias, with a time delay in relation to one another in the direction of the contact switches by pivotal movement of said actuator cap about the axis disposed in the central one of said transmission elements.

2. The device in accordance with claim 1, wherein each of said transmission elements comprises a tappet mounted in an axially movable arrangement in the housing and a coil spring supported in the housing, said springs being adapted to hold the tappets in an initial position and permit the tappets to be moved after having been actuated.

3. The switching device in accordance with claim 1, wherein the contoured inner surface of said actuator cap is subdivided into a plurality of subsections, each of the subsections being adapted to receive one of said transmission elements.

4. The switching device in accordance with claim 3, wherein the contoured inner surface is structured in a the plurality of protruding subsections and at least two of said subsections display a mirror image to one another.

5. The switching device in accordance with claim 4, wherein two outer ones of said transmission elements are aligned with and spaced from one another, and a middle transmission element is arranged laterally offset from the two outer transmission elements.

6. The switching device in accordance with claim 5, wherein four of said transmission elements are arranged symmetrically in relation to one another and pairs of said transmission elements each are disposed in one of two planes.

7. The switching device in accordance with claim 6, wherein the two planes are disposed at right angles to one another.

8. The switching device in accordance with claim 1, wherein a stop is provided on a selected one of the internal jacket surface of said actuator cap and on the outside thereof and acts in conjunction with the housing to limit a swiveling angle of said actuator cap.

9. The switching device in accordance with claim 1, wherein the contoured surface is configured such that said actuator cap is biased so as to be centered on said transmission elements.

10. The switching device in accordance with claim 1, wherein two guide grooves running in parallel to one another are disposed in said actuator cap with a guide rail formed on the housing disposed in each of said grooves, said actuator cap being movable in a linear direction along the guide rails and the contoured surface being disposed in the inner jacket surface of said actuator cap, such that said transmission elements are activatable by movement of said actuator cap.

11. The switching device in accordance with claim 1, wherein the switching device is adapted to be used in a vehicle for at least one of actuating a window, moving an exterior mirror, moving a rear-view mirror, and moving a seat position.

* * * * *